US006745564B2

(12) United States Patent
Koo

(10) Patent No.: US 6,745,564 B2
(45) Date of Patent: Jun. 8, 2004

(54) HYDRAULIC VARIABLE CONTROL APPARATUS FOR HEAVY CONSTRUCTION EQUIPMENT

(75) Inventor: Bon Seok Koo, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 10/247,547

(22) Filed: Sep. 19, 2002

(65) Prior Publication Data

US 2003/0115865 A1 Jun. 26, 2003

(30) Foreign Application Priority Data

Dec. 21, 2001 (KR) ..... P2001-0082751
Dec. 21, 2001 (KR) ..... P2001-0082765

(51) Int. Cl.[7] ..... F15B 11/05; F15B 13/04
(52) U.S. Cl. ..... 60/459; 91/444; 91/461
(58) Field of Search ..... 60/422, 420, 426, 60/459, 484; 91/444, 446, 448, 461, 511, 512

(56) References Cited

U.S. PATENT DOCUMENTS 5,025,625 A * 6/1991 Morikawa ..... 60/426
5,433,076 A * 7/1995 Sugiyama et al. ..... 91/461
5,921,165 A * 7/1999 Takahashi et al. ..... 91/461
2003/0000373 A1 * 1/2003 Weber et al. ..... 91/446

* cited by examiner

*Primary Examiner*—Thomas E. Lazo
(74) *Attorney, Agent, or Firm*—Ladas & Parry

(57) ABSTRACT

A seat valve body mounted in a hydraulic line between a pump line and feeder lines to control hydraulic fluid supplied to variable throttles and to auxiliarily control hydraulic fluid flowing in a load line comprises a first seat valve having a variable control throttle displaced by a difference between a load pressure of the load line and a discharge pressure of the hydraulic pump and varying an opening area from the pump line to the feeder lines based on a displacement amount thereof, a second seat valve having a pilot variable control throttle displacing with respect to the first seat valve, determining a displacement amount of the first seat valve, and varying an opening area based on a displacement amount thereof; and a pilot spool having a pilot variable throttle determining a displacement amount of the pilot variable control throttle of the second seat valve upon switching.

6 Claims, 7 Drawing Sheets

PRIOR ART

HYDRAULIC VARIABLE CONTROL APPARATUS FOR HEAVY CONSTRUCTION EQUIPMENT

TECHNICAL FIELD

The present invention relates to a hydraulic variable control apparatus for heavy construction equipment which is capable of variably controlling hydraulic fluid being supplied to an actuator.

More particularly, the present invention relates to a hydraulic variable control apparatus having inside a block of a reversing valve an auxiliary hydraulic control valve controlling hydraulic fluid flowing in and out of a hydraulic cylinder to reduce the number of parts for less costs, and capable of being used in a narrow place with preventing layout interferences when designing due to a compact structure thereof, and to be employed in a narrow space.

PRIOR ART

As schematically shown in FIG. 1, a conventional hydraulic control apparatus for heavy construction equipment is provided with a hydraulic pump 200 connected to an engine, a hydraulic cylinder 300 connected to the hydraulic pump 200 and driven by supplied hydraulic fluid, a reversing valve 100 mounted between the hydraulic pump 200 and the hydraulic cylinder 300 and for controlling hydraulic fluid to start, stop, and direction-switch the hydraulic cylinder 300, and an auxiliary hydraulic control valves 400(400A and 400B) mounted in load lines 6A and 6B between the reversing valve 100 and the hydraulic cylinder 300 to restrain hydraulic fluid being supplied to the hydraulic cylinder 300 and control a driving speed thereof.

A reference numeral 4 not described denotes a center bypass line, and 500 a relief valve draining hydraulic fluid to a tank T when a load occurs which excesses a pressure set in the circuit.

Accordingly, if an operator manipulates a control lever (not shown), a pilot signal pressure is applied to the right end of the reversing valve 100 and switches an inner spool to the left direction. With this, the hydraulic fluid discharged from the hydraulic pump 200 is supplied to the large chamber of the hydraulic cylinder 300 via a pump line 5, the switched reversing valve 100, and the load line 6A, and, at the same time, the hydraulic fluid discharged from a small chamber 31 of the hydraulic cylinder 300 returns to the tank T via a check valve 405B and the load line 6B, so the hydraulic cylinder 300 is activated extended.

In the meantime, when the reversing valve 100 is switched to the right direction of the drawing, the hydraulic fluid discharged from the hydraulic pump 200 is supplied to the small chamber 301 of the hydraulic cylinder 300, so the hydraulic cylinder 300 is activated retracted.

Depending on work conditions, in case of restraining the hydraulic fluid supplied to the hydraulic cylinder 300 and controlling an operation speed of the hydraulic cylinder 300, the auxiliary hydraulic control valve 400A can control the hydraulic fluid flowing in the large chamber 302 due to a pressure difference between pilot pressures 402A and 403A corresponding to an opening amount of a throttle 401A and a pre-set valve spring 404A.

However, the hydraulic control apparatus as stated above requires an extra block to install the auxiliary hydraulic control valve 400 in a hydraulic line between the load lines 6A and 6B of the reversing valve 100 and the hydraulic cylinder 300, causing a problem that its cost increase due to the increase of the number of parts and it is not available in a place of narrow space due to layout interferences when designing.

Further, the auxiliary control valve 400 is not provided with a check function for preventing reverse flows in case that a load pressure on the side of the hydraulic cylinder 300 is higher than a discharge pressure on the side of the hydraulic pump 200, so there is a problem of mounting an extra check valve 3 in the pump line 5 of the reversing valve 100.

SUMMARY OF THE INVENTION

Accordingly, it is an object of the present invention to provide a hydraulic control apparatus having inside a block of a reversing valve an auxiliary hydraulic control valve controlling hydraulic fluid to reduce the number of parts for less costs, and capable of being used in a narrow place with preventing layout interferences when designing due to a compact structure thereof.

It is another object of the present invention to provide a hydraulic control apparatus performing a check function of reverse flow preventions which has an excellent response when a discharge pressure of a hydraulic pump is higher than a load pressure of a working device to enhance reliability thereof.

It is yet another object of the present invention to provide a hydraulic circuit using a hydraulic control apparatus for heavy construction equipment, capable of constantly supplying set hydraulic fluid to an actuator regardless of variations of a load pressure of a working device and a pressure of the hydraulic pump.

In order to achieve the above objects, in a hydraulic control apparatus for heavy construction equipment having an actuator driven in connection to a pump line of a hydraulic pump, a hydraulic control valve mounted to a hydraulic line between the hydraulic pump and the actuator and switched upon an application of a pilot signal pressure to control flows of hydraulic fluid, and a seat valve body mounted in a hydraulic line between the pump line and hydraulic feeders to control hydraulic fluid supplied to the actuator and to auxiliarily control hydraulic fluid flowing in a load line, a hydraulic control apparatus according to the present invention comprises the seat valve body having a first seat valve displaced by a difference between a load pressure of the load line and a discharge pressure of the hydraulic pump in the hydraulic line between the pump line and the feeder lines, and varying an opening area between the pump line and the feeder lines based on a displacement amount thereof, a second seat valve displacing with respect to the first seat valve to press an elastic unit inserted between the first seat valve and the second seat valve and determining a displacement amount of the first seat valve; and a pilot spool having a pilot variable throttle, and controlling an opening degree of the pilot variable throttle with switching and determining a displacement amount of the second seat valve.

According to a preferred embodiment of the present invention, the first seat valve has a variable control throttle varying an opening area from the pump line to the feeder lines based on a displacement amount of the first seat valve, the second seat valve is provided with an auxiliary variable control throttle that an outer circumferential surface of the second seat valve is tiltedly formed with respect to a housing of the seat valve body, and varies an opening area between the outer circumferential surface of the second seat valve and the housing of the seat valve body based on a displacement amount of the second seat valve.

The pilot spool may be switched upon an application of the pilot signal pressure, or switched by a difference between signal pressures before and after main variable throttles mounted between the load line and a port of the hydraulic cylinder.

Further, a reverse flow-preventing check valve is mounted in the pilot signal pressure line formed in the seat valve body to prevent a load pressure in the load line from reverse flows to the pump line upon activating the hydraulic cylinder.

BRIEF DESCRIPTION OF THE DRAWINGS

The above objects and other features of the present invention will become more apparent by describing in detail a preferred embodiment thereof with reference to the attached drawings, in which.

DETAILED DESCRIPTION OF THE INVENTION

Hereinafter, preferred embodiments of the present invention are described in detail with reference to the accompanying drawings, which is a detailed description for one skilled in the art to which the invention pertains to implement the invention with ease and does not mean defining the technical scope and spirit of the present invention.

Figure 1:
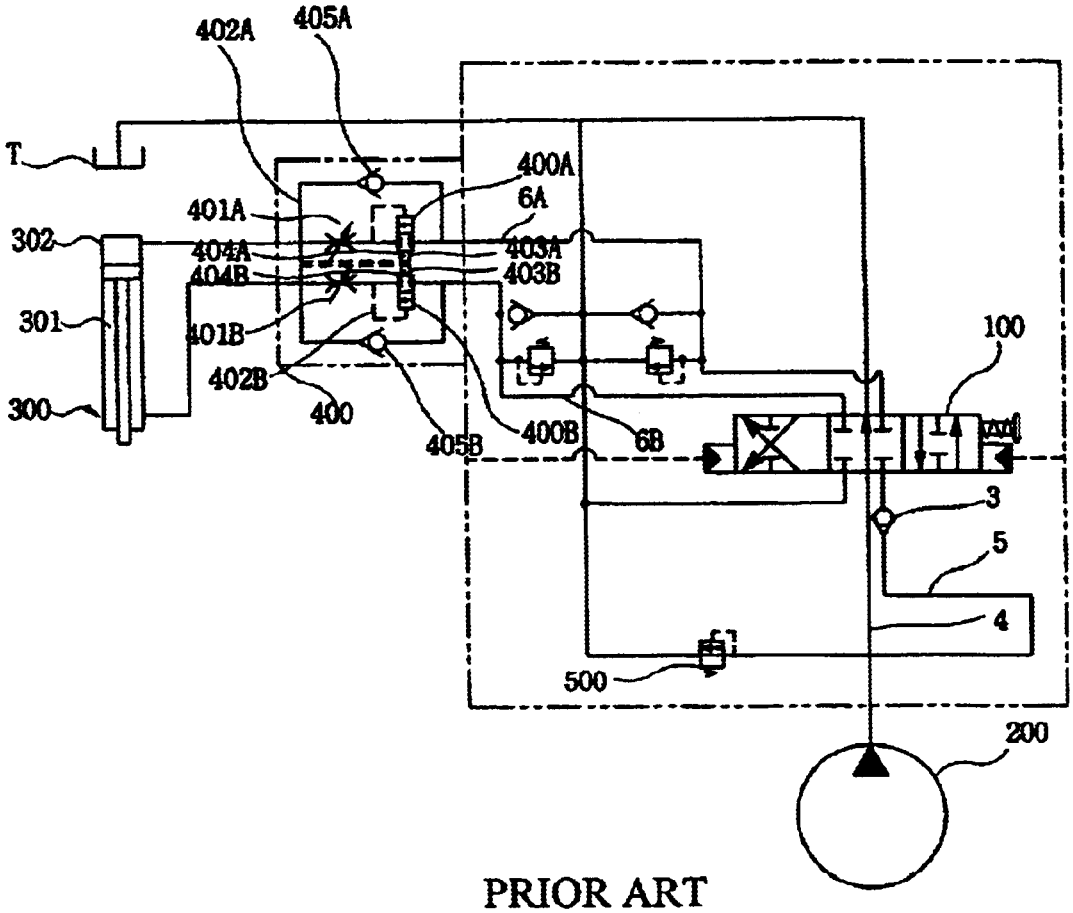
FIG. 1 is a view for showing a conventional hydraulic circuit of a hydraulic control apparatus.
Figure 2:
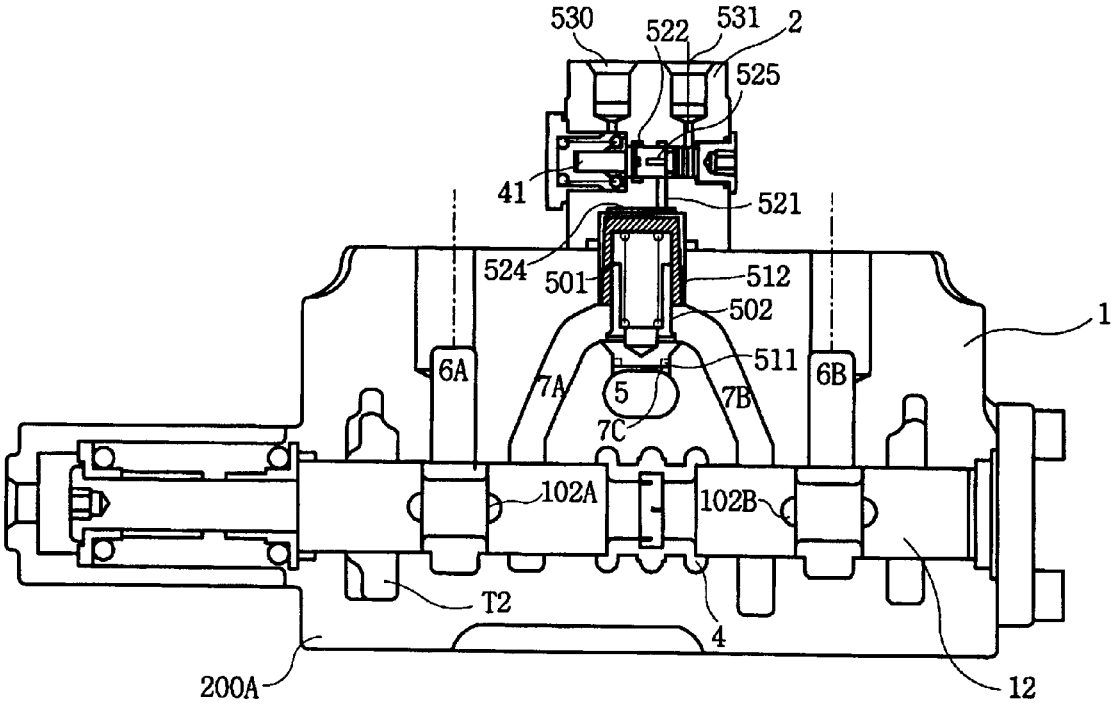
FIG. 2 is a cross-sectioned view for showing a reversing valve in which seat valves are formed according to an embodiment of the present invention.
Figure 3A:
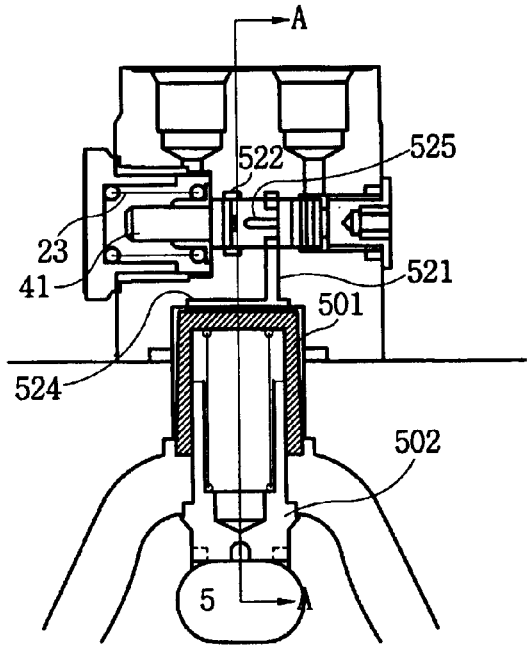
FIG. 3*a* is a cross-sectioned view taken from the front of a seat valve body out of a hydraulic control apparatus according to an embodiment of the present invention, and FIG. 3*b* a cross-sectioned view taken along line A—A of FIG. 3*a;*
Figure 3B:
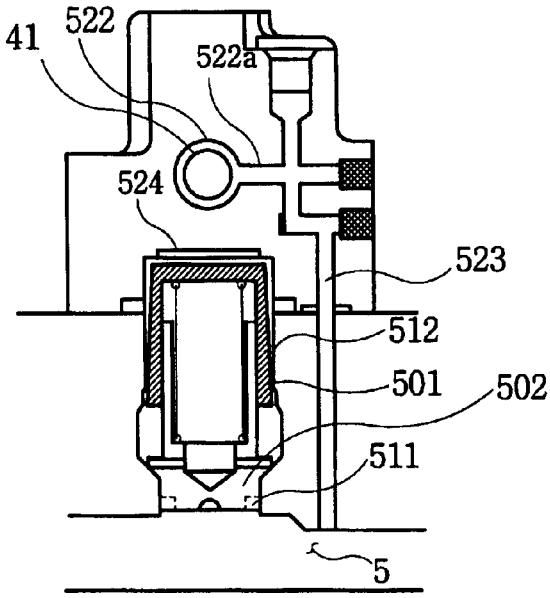
FIG. 3*c* is a cross-sectioned view taken along line A—A of the seat valve body of FIG. 3*a* in which a check valve is mounted.
Figure 3C:
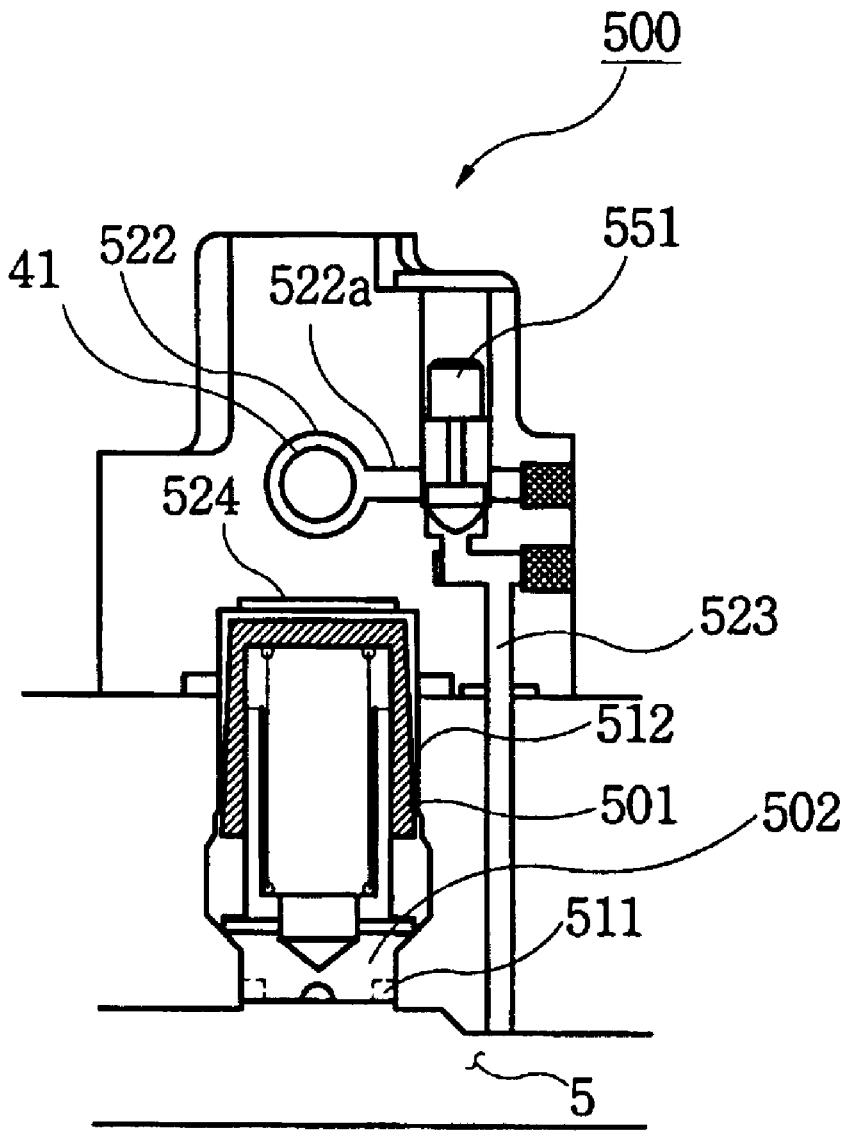
Figure 4:
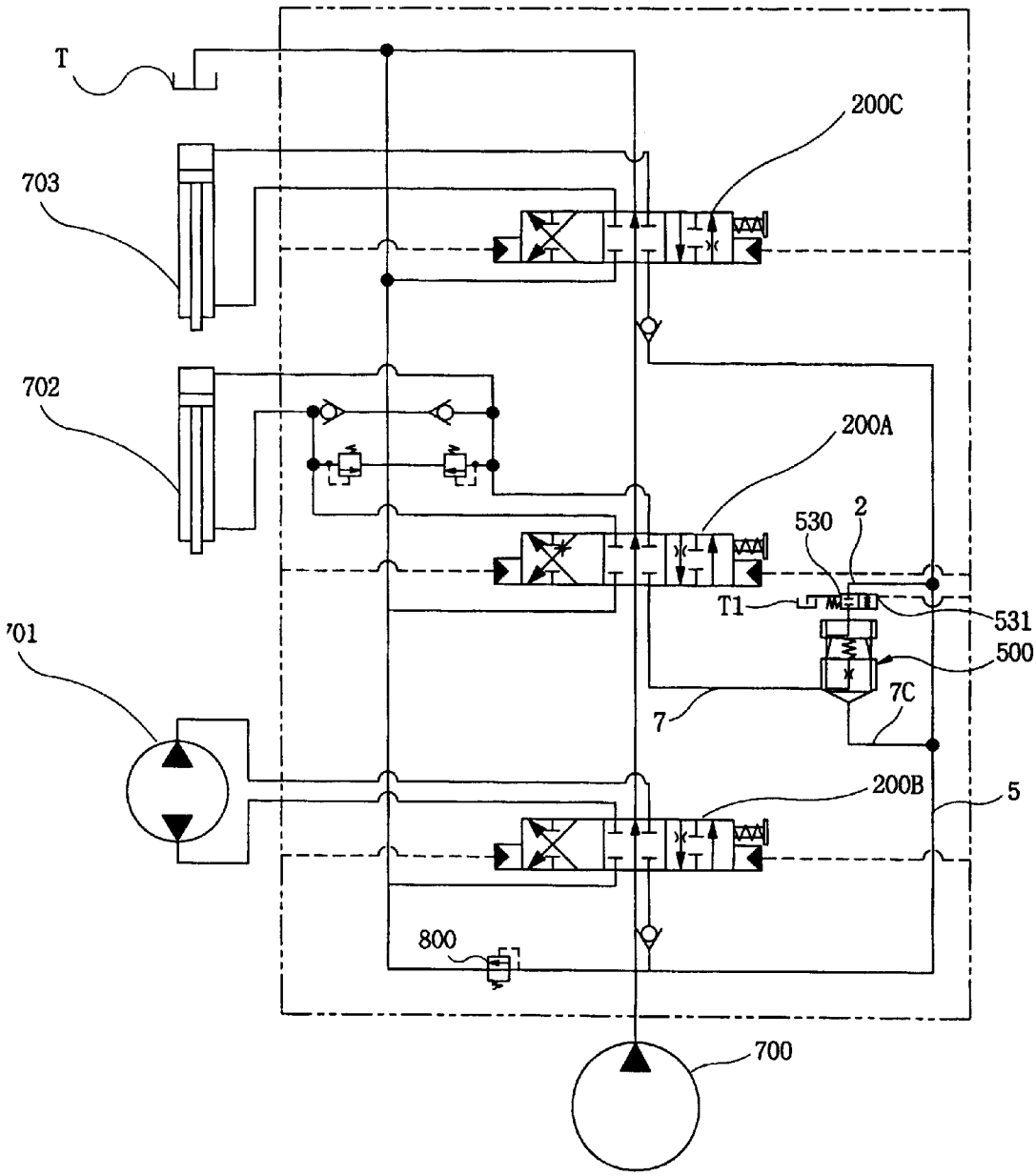
FIG. 4 is a view for showing a hydraulic circuit of a hydraulic control apparatus according to an embodiment of the present invention.

FIG. 2, FIG. 3*a*, FIG. 3*b*, and FIG. 3*c* are cross-sectioned views of a seat valve body according to an embodiment of the present invention, and FIG. 4 is a view for showing a hydraulic circuit using the seat valve body.

Referring to the drawings, a seat valve body 500 according to the present invention is provided with a first seat valve 502 mounted in the pump line 5 and the hydraulic feeders 7A and 7B to control an opening degree, a second seat valve 501 controlling an ascending amount of the first seat valve, and a pilot spool 41 supplying a pilot pressure fluid to a pressure chamber 524 of the second seat valve 501.

The first seat valve 502 is located in a hydraulic line between the pump line 5 and the hydraulic feeders 7A and 7B and has a variable control throttle 511 varying an opening area from the pump line 5 to the hydraulic feeders 7A and 7B based on a displacement amount, the second seat valve 501 determines a displacement amount of the first seat valve 502 by displacing with respect to the first seat valve 502 when the pilot pressure fluid is supplied to the pressure chamber 524 through a pilot hydraulic line 521. Further, the second seat valve 501 is provided with a pilot auxiliary variable control throttle 512 varying an opening area between a housing 1 and an outer circumferential surface based on a displacement amount thereof.

A spring, which is a elastic unit, is inserted between the first seat valve 502 and the second seat valve 501, and a position of the second seat valve 501 affects up and down displacements of the first seat valve 502.

A hydraulic pressure of the pump line 5 is applied to the pressure chamber of the second seat valve 501 through pump pressure pilot connection lines 523, 522*a*, 522, and 521. At this time, the pilot spool 41 is positioned between the lines 522 and 521, and a variable throttle 525 formed in the pilot spool 41 is displaced to open and close the lines 522 and 521 based on the displacement of the pilot spool 41.

In proportion to a difference between an opening amount of the variable throttle 525 and an opening amount of the pilot control variable throttle 512 based on the displacement of the pilot spool 41, the second seat valve 501 is displaced downwards, which restrains an upward displacement of the first seat valve 502.

At this time, as shown in FIG. 3*c*, a reverse flow-preventing check valve 551 may be mounted between pilot signal pressure lines 522*a* and 523 in order to prevent load pressures in the load lines 6A and 6B in the load lines 6A and 6B from reverse flows into the pump line 5 when the hydraulic cylinder 300 is activated.

FIG. 4 is a view for showing a circuit of a hydraulic control apparatus controlling hydraulic fluid with an application of a pilot signal pressure to the pressure chamber 531 of the seat valve body 500.

Referring to FIG. 4, a hydraulic control apparatus according to the present invention has a hydraulic pump 700, actuators 701, 702, and 703 driven in connection to the pump line 5 of the hydraulic pump 700, hydraulic control valves 200A, 200B, 200C mounted between the hydraulic pump 700 and the actuators 701, 702, and 703 and switched upon a pilot signal pressure to control flow directions of hydraulic fluid in order to start, stop, and direction-switch the actuators 701, 702, and 703, and the seat valve body 500 mounted in a hydraulic line between the pump line 5 and the hydraulic feeder 7 to control hydraulic fluid to be supplied to the actuators and to auxiliarily control hydraulic fluid flowing in the load lines 6A and 6B, and the pilot signal pressure is applied to the pressure chamber 531.

Hereinafter, operations of the hydraulic variable control apparatus for heavy construction equipment according to the present invention are described in detail with reference to FIG. 2 to FIG. 4.

First, in case that the pilot signal pressure 531 is not applied, the first seat valve 502 is upwards and downwards displaced with a difference between a load pressure of the load lines 6A and 6B and a pressure of an upstream side line 7C of the hydraulic pump 700, so as to cut off between the upstream side line 7C and downstream side lines 7A and 7B of the feeder line 7 with time delay even in case that a pressure in the load lines 6A and 6B becomes higher than a discharge pressure of the hydraulic pump 700, to thereby prevent reverse flows in case that a high load occurs in the hydraulic cylinder 702.

The pilot signal pressure is applied in case of restraining hydraulic fluid for a hydraulic pressure flowing in the hydraulic cylinder 702 in order to drive a hydraulic motor 701, and so on.

If a pilot signal pressure is applied to the pressure chamber 531, the pilot spool 51 is displaced to the left direction of the drawing in proportion to a magnitude of the signal pressure applied, and the displacement of the spool 41 opens the variable throttle 525. Accordingly, the pilot lines 522 and 521 are connected, a hydraulic pressure of the pump line 5 is applied to the pressure chamber 524 via the pilot lines 523, 522*a*, 522, and 521 to press the second seat valve 501 downwards.

Accordingly, the downward displacement of the second seat valve 501 causes the spring to be pressed, which controls the upward displacement of the first seat valve 502 positioned between the pump line 5 and the hydraulic feeders 7A and 7B, enabling the control of hydraulic fluid from the upstream side line 7C of the hydraulic pump 700 to the hydraulic feeder 7.

Figure 5:
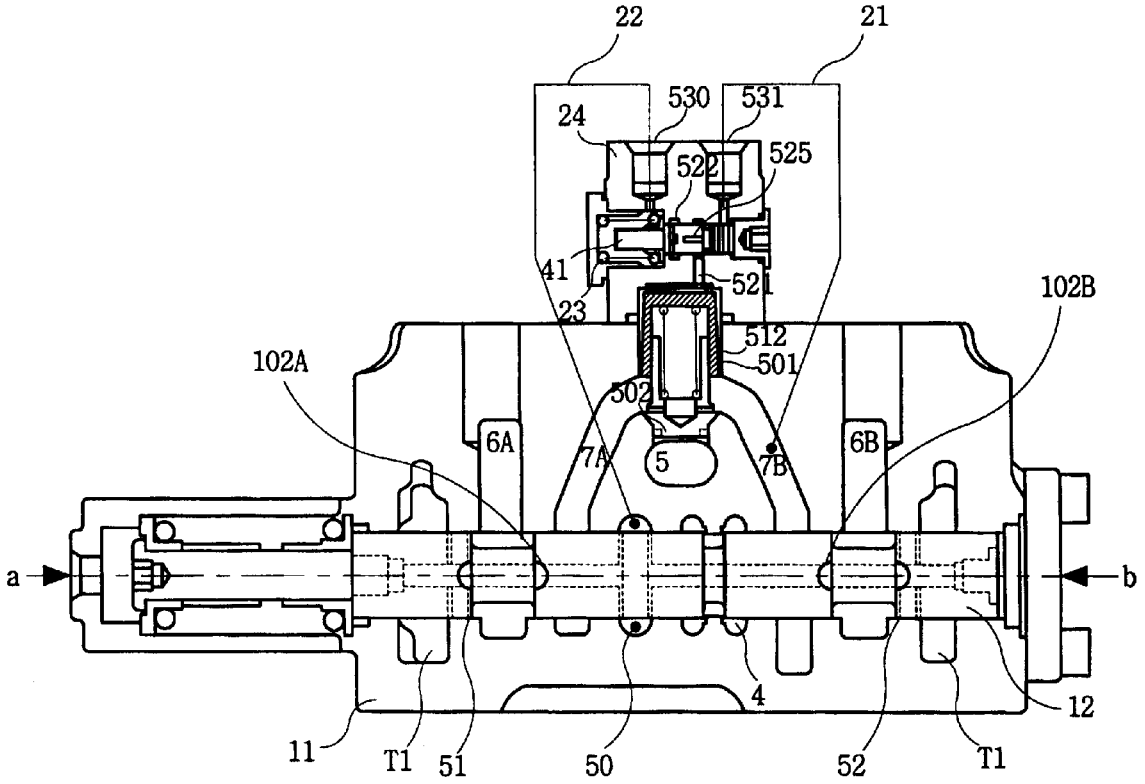
FIG. 5 is a cross-sectioned view of a reversing valve in which a seat valve body is formed according to another embodiment of the present invention.
Figure 6:
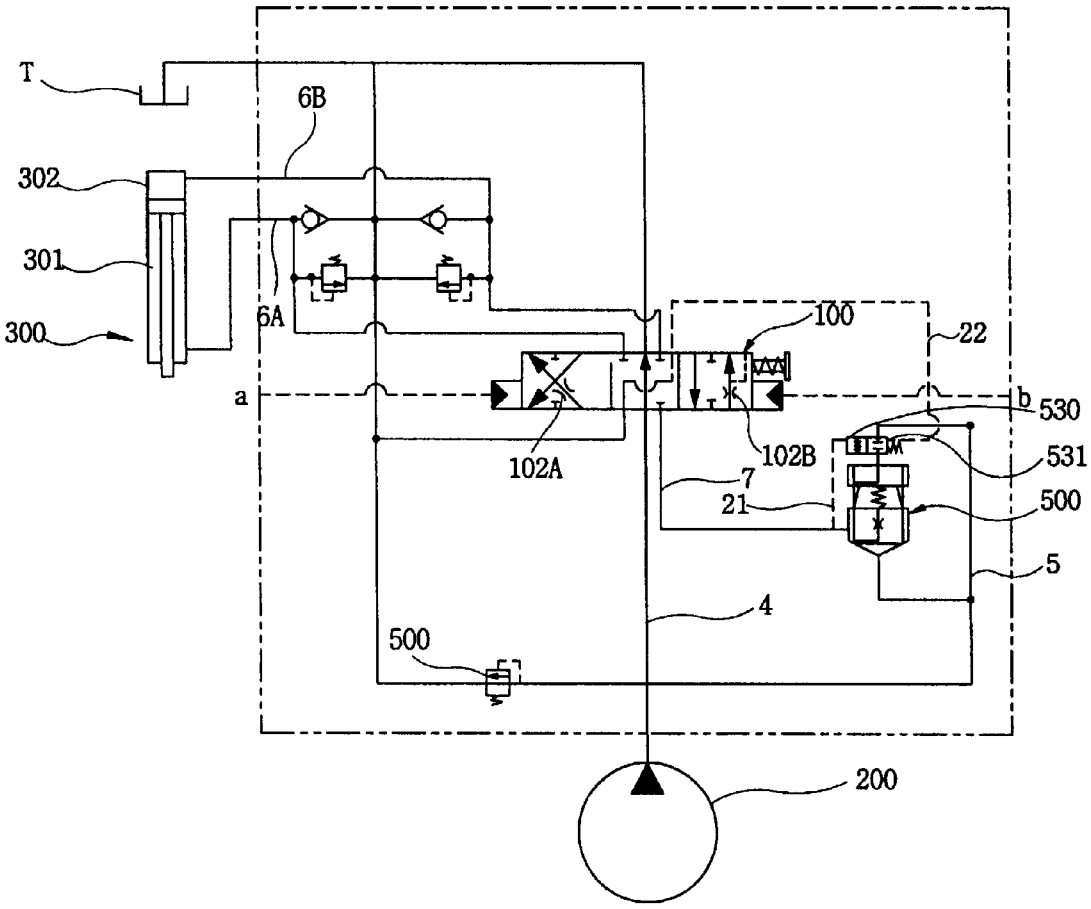
FIG. 6 is a view for showing a hydraulic control apparatus according to another embodiment of the present invention.

FIG. 5 and FIG. 6 are views for showing another embodiment controlling a hydraulic pressure by using a seat valve body according to the present invention, FIG. 6 shows a hydraulic circuit in which pressures before and after a main variable throttle of a reversing valve are respectively connected to a pressure chamber of a seat valve body according to the present invention, and FIG. 5 is a cross-sectioned view of a reversing valve in which the seat valve body is formed.

Referring to FIG. 6, a hydraulic control apparatus according to the present embodiment has the hydraulic pump 200, an actuator 300 driven in a parallel connection to the pump line 5 of the hydraulic pump 200, the reversing valve 100 mounted in a hydraulic line between the hydraulic pump 200 and an actuator 300 and switched upon an application of a pilot signal pressure to control flow directions of hydraulic fluid so as to start, stop, and direction-switch the actuator 300, and a seat valve body 500 mounted in a hydraulic line between the pump line 5 and the hydraulic feeder 7 to control hydraulic fluid being supplied to the actuator and to auxiliarily control hydraulic fluid flowing in the load lines 6A and 6B.

The pilot spool 41 in the present embodiment, unlike the preceding embodiment, has a state determined by pressures 21 and 22 before and after main variable throttles 102A and 102B of the reversing valve 100. That is, the pilot spool 41 is switched by a difference between pressures of both the left and right pressure chambers of the pilot chamber 25.

The procedures for controlling hydraulic fluid according to the present embodiment are described with reference to FIG. 5.

In case of limiting hydraulic fluid to be supplied to the hydraulic cylinder 300 for the purpose for controlling an operation speed of the hydraulic cylinder and so on, a pilot signal pressure b is applied to the right end of the reversing valve 100, which switches a spool 12 inside the reversing valve 100 to the left direction of the drawing.

When the spool 12 of the reversing valve 100 is switched, the pressure 21 before the main variable throttles 102A and 102B of the reversing valve 100 is connected to the pilot pressure chamber 531 of a pilot-switching valve 24, and the pressure 22 after the main variable throttles 102A and 102B is applied to a line 50 through a pressure line 52 formed in the spool 12. The pressure of the line 50 is applied to the pilot pressure chamber 530 through the pressure line 22.

The pilot spool 41, when neutral, cuts off an application of the a hydraulic pressure of the pump line 5 to the pressure chamber 524 by way of the pilot lines 523, 522*a*, 522, and 521.

A position of the pilot spool 41 is determined by the pressures 21 and 22 of the main variable throttles 102A and 102B of the reversing valve 100 and an elastic force of a pre-set valve spring 23, and the pilot spool 41 is switched in its position if a pressure difference of both the left and right pressure chambers 530 and 531 thereof excesses the elastic force of the valve spring.

At this time, the hydraulic fluid of the pump line 5 flows in the pressure chamber 524 by way of the pilot lines 523, 522*a*, 522, and 521, and the first seat valve 502 is displaced to the downward direction of the drawing in proportion to a difference between an opening amount of the pilot variable throttle 512 and an opening amount of an auxiliary pilot variable throttle 512 formed in the second seat valve 501, to thereby limit an ascending amount of the first seat valve 502. Accordingly, hydraulic fluid flowing in the hydraulic feeders 7A and 7B and the load lines 6A and 6B can be controlled.

In the meantime, in case that a discharge pressure of the hydraulic pump 200 is higher than a load pressure of the hydraulic cylinder 300, the first seat valve 502 can perform a check valve function since the first seat valve 502 is in cut-off state.

As stated above, the preferred embodiments have an advantage as below.

The load pressure on the side of the actuator higher than the discharge pressure of the hydraulic pump can enhance reliability with excellent responses when a reverse flow-preventing check function is carried out. Further, its simplified structure may facilitate its manufacture to lower the cost and manufacturing expenses, and can secure the stability of a hydraulic system.

What is claimed is:

1. A hydraulic control apparatus for heavy construction equipment having an actuator driven in connection to a pump line of a hydraulic pump, a hydraulic control valve mounted to a hydraulic line between the hydraulic pump and the actuator and switched upon an application of a pilot signal pressure to control flows of hydraulic fluid, and a seat valve body mounted in a hydraulic line between the pump line and hydraulic feeders to auxiliarily control hydraulic fluid flowing in a load line, the seat valve body comprising:

a first seat valve displaced by a difference between a load pressure of the load line and a discharge pressure of the hydraulic pump in the hydraulic line between the pump line and the feeder lines, and varying an opening area between the pump line and the feeder lines based on a displacement amount thereof;

a second seat valve displacing with respect to the first seat valve and determining a displacement amount of the first seat valve; and a pilot spool having a pilot variable throttle, and controlling an opening degree of the pilot variable throttle with switching and determining a displacement amount of the second seat valve.

2. The hydraulic control apparatus as claimed in claim 1, wherein the first seat valve has a variable control throttle varying an opening area between the pump line and the feeder lines based on a displacement amount of the first seat valve.

3. The hydraulic control apparatus as claimed in claim 1, wherein the second seat valve is provided with an auxiliary variable control throttle with respect to a housing on an outer circumferential surface thereof, and an opening area between the outer circumferential surface of the second seat valve and the housing of the seat valve body varies based on a displacement amount of the second seat valve.

4. The hydraulic control apparatus as claimed in claim 1, wherein the pilot spool is switched upon an application of the pilot signal pressure to control hydraulic fluid.

5. The hydraulic control apparatus as claimed in claim 1, wherein the pilot spool is switched by a difference between signal pressures before and after main variable throttles mounted between the load line and a port of the hydraulic cylinder to control hydraulic fluid.

6. The hydraulic control apparatus as claimed in claim 1, wherein a reverse flow-preventing check valve is mounted in the signal pressure line formed in the seat valve body to prevent a load pressure in the load line from reverse flows to the pump line upon activating the hydraulic cylinder.

* * * * *